United States Patent [19]

Kim

[11] 4,064,570

[45] Dec. 27, 1977

[54] COMPACT SHOWER STRUCTURE

[76] Inventor: Sunyong P. Kim, 3805 S. Norton Ave., Los Angeles, Calif. 90008

[21] Appl. No.: 680,422

[22] Filed: Apr. 26, 1976

[51] Int. Cl.[2] ..... A47K 3/23

[52] U.S. Cl. ..... 4/147; 4/154; 135/5 B; 312/5; 312/138 A

[58] Field of Search ..... 4/146, 147, 151, 154, 4/156, 161, 116; 135/5 B, 1 A, 3 A, 4 A, 5 AT; 312/3–6, 138 A, 237; 296/23 A, 23 F, 23 G, 23 H; 5/113, 362

[56] References Cited

U.S. PATENT DOCUMENTS

| | | | |
|---|---|---|---|
| 462,125 | 10/1891 | Grant | 4/146 |
| 1,566,387 | 12/1925 | Fifield | 4/146 |
| 1,750,284 | 3/1930 | Rusatz | 4/146 X |
| 2,122,681 | 7/1938 | Dykes | 135/5 B |
| 2,466,378 | 4/1949 | Charteris | 4/146 |
| 2,561,265 | 7/1951 | Burns | 4/146 |
| 3,629,875 | 12/1971 | Dow et al. | 4/154 X |
| 3,633,324 | 1/1972 | Cuylits et al. | 296/23 G X |
| 3,743,345 | 7/1973 | Eckman et al. | 135/5 AT X |
| 3,925,828 | 12/1975 | Kim | 4/147 |

*Primary Examiner*—Richard E. Aegerter
*Assistant Examiner*—Stuart S. Levy
*Attorney, Agent, or Firm*—John T. Matlago

[57] ABSTRACT

A bathing facility for a camper vehicle comprises a door which is hinged to a frame attached to an interior wall of the vehicle. The rear of the door is formed with a shallow recess for storing the collapsed adjacent flexible sidewalls and bottom of a rectangular enclosure, the other adjacent sidewalls of which are formed by the wall portion within the frame and the door itself when the latter is held ajar. Arms pivoting outwardly from the rear upper and lower corners of the recessed door serve to extend the flexible sidewalls. A foot-operated double-acting suction pump located on the bottom of the enclosure serves to pump in fresh water to a shower head from a first external container and to pump used water from the bottom of the enclosure to a second external container.

5 Claims, 6 Drawing Figures

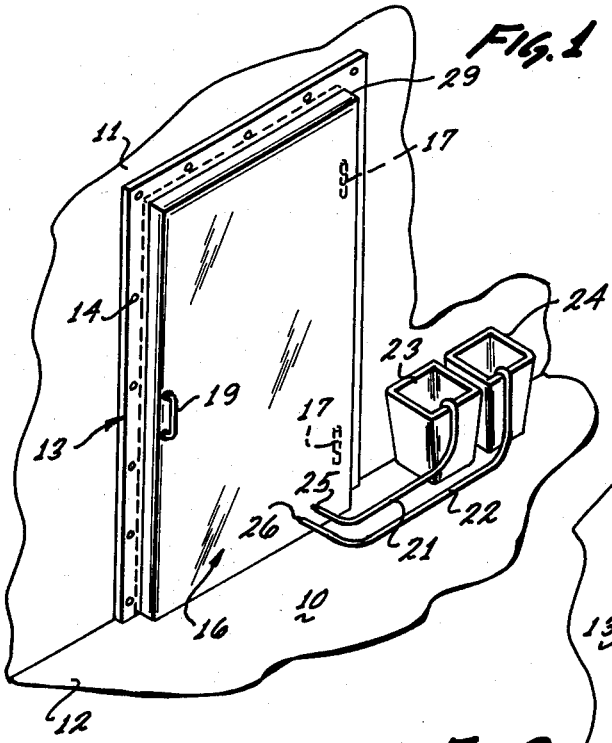
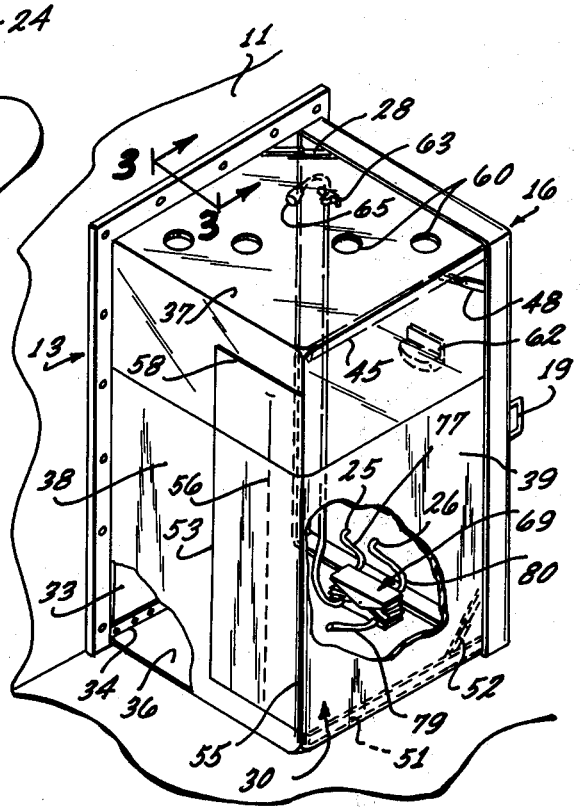
FIG. 2
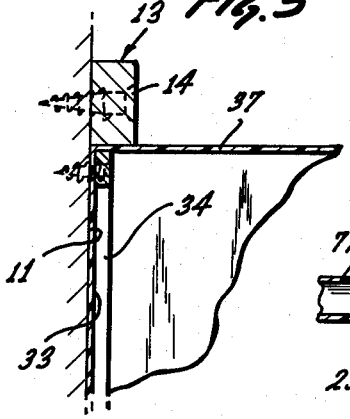
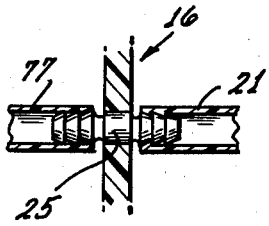
FIG. 6
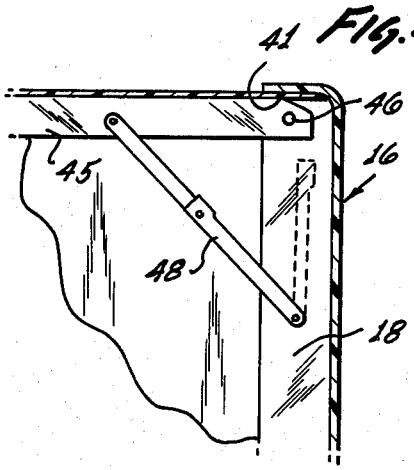
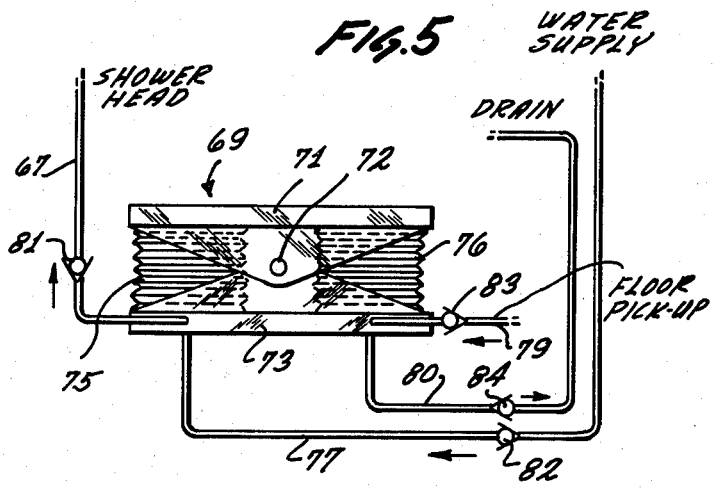

COMPACT SHOWER STRUCTURE

This invention relates to bathing facilities and more particularly to a compact shower structure.

It is highly desirable to provide a bathing facility for a camper vehicle. However, because of the space limitations within the interior of the camper vehicle it is difficult to justify such an installation. There is thus a need for a simple, inexpensive, easily usable bathing facility for use in a camper vehicle that takes up a minimum of space.

Accordingly, one of the objects of the present invention is to provide a simple, compact shower structure for mounting on the wall of a camper vehicle.

Another object of the invention is to provide a compact shower structure that enables a rectangular enclosure to be formed by opening up a door hingedly mounted on a wall.

Still another object of the present invention is to provide a compact shower structure having a foot-operated double-acting suction pump therein for supplying fresh bathing water and for removing the used water.

Briefly the compact shower unit of the present invention provides a rectangular frame which is attached to the interior wall of a camper vehicle, for example. A door having a recessed back wall is fitted in the frame and connected by hinges to a side thereof. Wall structure formed of flexible plastic material is collapsed within the recess of the door when closed. When the door is swung open such that it is normal to the frame, the wall within the frame opening and the door form two adjacent sides of a rectangular enclosure while the other two adjacent sides of the rectangular enclosure, as well as the bottom thereof, are formed by the flexible wall structure which is extended by use of hinged arms on the upper and lower corners of the recessed door.

With these and other objects and advantages in view, the invention consists of the construction, arrangement and combination of the various parts of the device whereby the objects contemplated are attained, as herein set forth, pointed out in the appended claims and illustrated in the accompanying drawings.

In the drawings:

FIG. 1 illustrates the compact shower unit of the present invention mounted on the interior wall of a camper vehicle;

FIG. 2 is a perspective view showing the shower unit in its open operative position;

FIG. 3 is a sectional view as taken along line 3—3 in FIG. 2;

FIG. 4 is a view of the folding brace on the door for supporting the upper arm;

FIG. 5 is a diagrammatic showing of the foot operated suction pump located on the floor of the shower unit, and FIG. 6 is a sectional view of a portion of the door showing one of the hose fittings mounted thereon.

Referring to the drawings, FIG. 1 shows the compact shower unit 10 of the present invention mounted on the interior wall 11 of a camper vehicle having a floor 12. The unit comprises a rectangular flat frame 13 which is securely attached to the wall 11 by screws 14. A door 16 is hinged at one side thereof to a side of the frame 13 by hinges 17. The door 16 is preferably molded of fiber glass material with a relatively shallow recess 18 on its rear surface. This recess causes the door to project outwardly from the opening of frame 13 when it is closed in the frame. A handle 19 is provided on the outer side of the door 16. The door gives the appearance of providing a conventonal entrance into another room.

Located near the bottom of the door 16 are a pair of hose fittings 25 and 26 (FIG. 6) having lines or hoses 21 and 22 connected thereto which respectively extend to a pair of containers 23 and 24 located on the floor 12 near the wall 11 adjacent the hinged end of the door. One of the containers 23 is used to provide a supply of fresh bathing water and the other container 24 is used to hold the water after it has been used for bathing.

When it is desired to use the compact shower unit 10, the door 16 is pulled open by its handle 19 and swung on its hinges 17 to a position normal to the frame 13. When the door is so opened its flat projecting side edge 29 contacts the flat frame 13 which limits its outer movement. Preferably the door is held in this open position by use of a folding brace 28 extending across the upper, inner corner of the frame and door.

A flexible wall structure 30 formed of plastic material is collapsed within the recess 18 on the back of the door 16 when the latter is closed against the frame. The flexible wall structure 30 of itself preferably forms a rectangularly shaped enclosure with one side 33 thereof facing the wall 11 within the frame and held in position on all four of its sides by strip members 34 fastened to the wall 11. The bottom 36, top 37, side 38 opposite the door 16 and side 39 opposite the door frame 13 are all integrally formed with the side 33 which is fastened to the portion of wall 11 enclosed within the door frame. The edges 41 of an open side of the flexible enclosure facing the door are secured to the inner periphery of the recess in door 16 by an adhesive, for example, as shown in FIG. 4.

An upper arm 45 located at the top corner of the door recess is hinged at 46 and provided with a folding brace 48. A lower arm 51 located at the lower inner corner of the door recess is similarly hinged and provided with a folding brace 52. The flexible wall structure 30 is provided with a flap 53 which extends from the outer corner 55 of the enclosure and overlaps a vertical slit 56 on the side 38. Note that slit 56 extends upwardly from a lower point which is well above the bottom 36 of the enclosure to ensure that the lower portion of the enclosure is water tight. The flap 53 is secured along its upper edge 58 to the side 38. Thus when the free lower corner portion of the flap 53 is pulled away, it exposes the slit 56 in the side 38. Because of the flexibility of the material and the resiliency of arm 45 the slit 56 can be readily opened up to enable a person to enter into the shower enclosure. The plastic material forming the sides of the enclosure is opaque except for a portion 59 near the top which may be transparent. In addition, openings 60 may be provided in the top 37 of the enclosure for ventilation purposes.

Mounted on the recessed back surface of the door 16 is a soap dish 62 and a clamp 63 on which a shower head 65 is held. A foot operated suction pump 69 is located on the bottom 36 of the shower enclosure. The foot pump 69 has a treadle 71 which is centrally pivotally held on a pin 72 by which it is connected to its base 73. A first bellows 75 is provided between the treadle and base on one side of the pivot pin 72 and a second bellows 76 is provided between the treadle and base on the other side of pivot pin 72. The first bellows 75 has an input hose 77 on its portion of the base which is connected to the hose fitting 25 on the door and an output hose 67 on its portion of the base which is connected to the shower head 65. The second bellows 76 has an input hose 79 on its portion of the base which lies on the bottom of the enclosure and an output hose 80 on its portion of the base which is connected to the hose fitting 26 on the door. It should be noted that the pump 69 is of such a size that when the door is closed it can be stored on the bottom of the rear recess 18. The rear recess 18 in the door also provides for storing the shower head 65 and the soap dish 62.

It should now be clear that the foot operated suction pump 69 is double acting. As the person is bathing he rocks the treadle 71 of the suction pump about its hinge pin 72 with his foot. This causes the bellows 75 on its upward movement to draw fresh water from the container 23 via hoses 21 and 27, and on its downward movement to force the water up to the shower head 65 via hose 67. The ball valves 81 and 82 are installed in the respective hoses 67 and 77 to aid this action. At the same time the rocking movement of treadle 71 causes the bellows 76 on its upward movement to draw in used water that has accumulated on the bottom of the shower enclosure via hose 79, and on its downward movement to force the used water via hoses 80 and 26 to the drain container 24 located on the side of the door. The ball valves 83 and 84 are installed in the respective hoses 79 and 80 to aid this action.

While in order to comply with the statutes the invention has been described in language more or less specific as to structural features, it is to be understood that the invention is not limited to the specific features shown, but that the means and construction herein disclosed comprises a preferred form of putting the invention into effect and the invention is therefore claimed in any of its forms or modifications within the legitimate and valid scope of the appended claims.

What is claimed is:

1. A compact shower structure comprising:

a rectangular flat frame attached to a wall;

a door having a recessed rear surface and hinged at one side thereof to a side of said frame such that the door can be swung to a closed position in which it fits in the opening provided by said frame;

a flexible wall structure capable of forming two adjacent sides and the bottom of a rectangular enclosure;

said flexible wall structure having portions thereof connected to the periphery of said frame and said door and having other portions thereof collapsed in the recess of said door when in its closed position in said frame;

said door when opened so as to be normal to said frame forming with the portion of said wall within said frame two adjacent sides of said rectangular enclosure;

a pair of arms pivotally connected to the respective upper and lower corners of the door which arms when disposed horizontally serve to extend the flexible wall structure to form the remaining two adjacent sides and the bottom of said rectangular enclosure; and a shower head mounted in said structure.

2. The invention in accordance with claim 1 wherein said shower head is removably supported on the inner surface of said door.

3. The invention in accordance with claim 2 including a double-acting foot-operated suction pump located on the bottom of said enclosure, a conduit for connecting said shower head to the outlet of one half of said pump, a conduit lying on the bottom of said enclosure connected to the inlet of the other half of said pump, a pair of conduit fittings on said door, a conduit connecting one of said conduit fittings to the inlet of said one half of said pump, and a conduit for connecting the other conduit fitting to the outlet on the other half of said pump.

4. The invention in accordance with claim 3 including a pair of containers located outside of said enclosure, and conduits connecting the containers to the respective conduit fittings on said door.

5. The invention in accordance with claim 1 wherein said frame has a flat surface and wherein said door has a flat vertical side which projects beyond the surface of said frame, and whereby when said door is opened said flat vertical side contacts the frame aned limits the opening movement of the door.

* * * * *